United States Patent [19]

Murr

[11] Patent Number: 4,716,704

[45] Date of Patent: Jan. 5, 1988

[54] FABRIC COVERED SPLINE ASSEMBLY

[75] Inventor: Henry F. Murr, Mountville, Pa.

[73] Assignee: Armstrong World Industries, Inc., Lancaster, Pa.

[21] Appl. No.: 946,767

[22] Filed: Dec. 29, 1986

[51] Int. Cl.[4] ..... E04C 2/00

[52] U.S. Cl. ..... 52/779; 52/509; 52/586; 52/716; 52/471

[58] Field of Search ..... 52/778, 779, 471, 509, 52/222, 586, 63, 238.1, 239, 716, 470; 16/7, 8

[56] References Cited

U.S. PATENT DOCUMENTS

| | | | |
|---|---|---|---|
| 2,231,316 | 2/1941 | Bailey | 52/716 |
| 2,662,620 | 12/1953 | Vojta | 217/696 X |
| 2,956,653 | 10/1960 | Liskey | 52/126.6 |
| 2,996,770 | 8/1961 | Norman | 52/716 |
| 3,508,369 | 4/1970 | Tennsion | 52/466 |
| 3,603,053 | 9/1971 | Van Loghen | 52/586 |
| 3,893,269 | 7/1975 | Nelsson | 52/71 |

*Primary Examiner*—John E. Murtagh

[57] ABSTRACT

The invention is directed to a spline structure for use with at least two wallboard structures. A vertical web is positioned between the butt edges of two wallboards and is provided with a decorative fabric coating to provide a decorative joint for the wallboard structures. Horizontal flanges from the vertical web member form fastening splines to hold the wallboard structures in position on a wall.

5 Claims, 2 Drawing Figures

FABRIC COVERED SPLINE ASSEMBLY

BACKGROUND OF THE INVENTION

The invention is directed to a spline structure for wallboards and particularly to a fabric covered decorative spline which is meant to provide a special esthetic appearance to the butt joint of the wallboards.

DESCRIPTION OF THE PRIOR ART

U.S. Pat. No. 2,942,704 shows a runner for a ceiling system. U.S. Pat. No. 3,000,474 is a disclosure of another spline structure.

U.S. Pat. No. 1,312,056 shows a butt joint with a bulb-like configuration being provided at the seam of the boards.

SUMMARY OF THE INVENTION

The invention is directed to a spline structure that has a vertical web member and horizontal flanges extending perpendicular from the vertical web. At least one set of horizontal flanges extends from the vertical web at the mid-region thereof to engage cuts or grooves in the mid-region of ceiling boards between which the spline is positioned. Other horizontal flanges extend from the base of the spline to permit the spline to be mounted to a wall structure. The upper end of the spline is covered with a fabric to form a fabric covered bulb-like structure which forms a decorative effect between the butt edges of two adjacent wallboards.

DESCRIPTION OF THE PREFERRED EMBODIMENT

Figure 1:
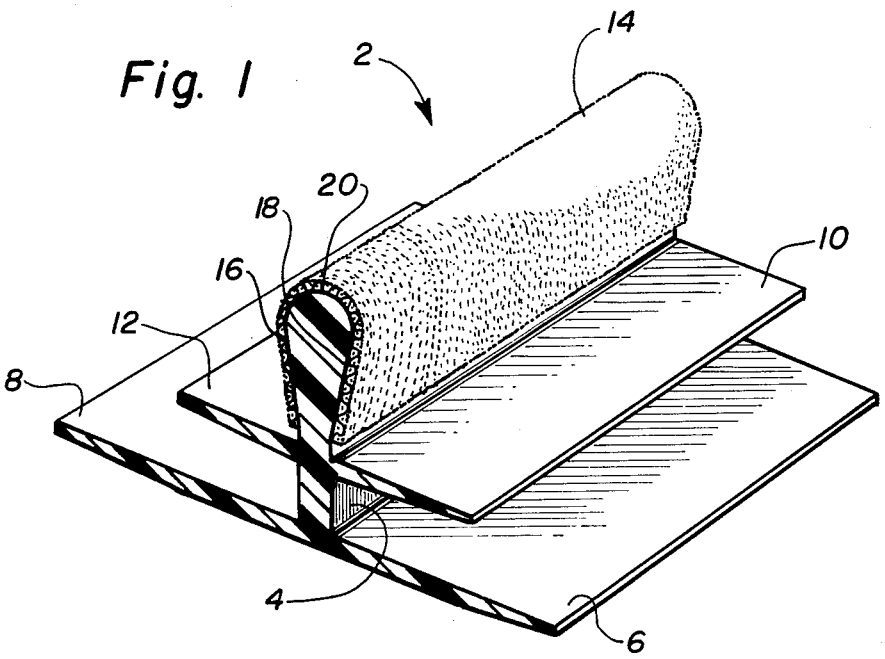
FIG. 1 is a perspective view of the spline invention herein.

A spline structure 2 is provided for use with at least two wallboard structures 22 and 24. The spline structure as shown in FIG. 1 has a vertical web 4. Horizontal long flanges 6 and 8 extend perpendicular an equal distance either side of the base of the web member. Horizontal short flanges 10 and 12 extend perpendicular an equal distance either side of the web member in the vicinity of the midpoint of the vertical web. A fabric material 14 covers the sides 16 and 18 and end 20 of the vertical web in the area from the short flanges to the end of the web opposite from the end of the web having the long flanges. The portion of the vertical web covered with the fabric material is enlarged with a semicircular cross-section formed at the end 20 of the vertical web.

Figure 2:
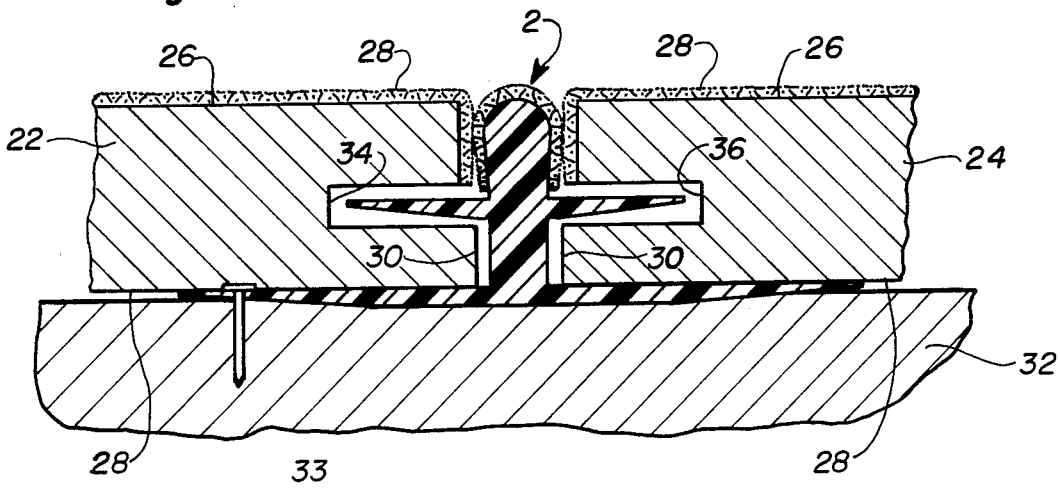
FIG. 2 is an end view of the spline structure mounted in position between two adjacent wallboards.

Referring now to FIG. 2, two wallboard structures 24 and 26 with a front 26, a back 28 and at least one side 30 are placed with their sides in an adjacent and slightly placed apart relationship with their backs against a structural wall 32. The wallboard front is covered with a fabric material 28. The spline structure is positioned between the sides 30 of the wallboards to fill the space between the sides of the wallboards with only one end of the spline structure visible in the space between the wallboards. The portion of the spline that is visible is the fabric covered portion of the spline. The semicircular cross-section of the spline is visible and it is covered with a fabric material so that the spline structure forms a joint between the two wallboards to provide the appearance of a semicircular bead between the adjacent wallboards. The wallboards at their adjacent sides have grooves 34 and 36 cut into the mid-region of the adjacent sides of the wallboards and the short flanges 10 and 12 are inserted into these grooves whereby the spline structure holds the wallboard in position relative to each other. The long flanges are fastened to the structural wall by nails or other like means 33 and therefore the spline holds the wallboards relative to the structural wall 32.

The splint assembly herein is not limited to a fabric covered or wrapped end detail. The decorated exposed end of the splint forming a bead between two wallboards could be decorated with a vinyl wrap, a flocked covering or a painted surface. Some type of decorative covering is provided to match or accent the wallboard covering.

What is claimed is:

1. A spline structure for use with at least two wallboard structures comprising:

(a) a narrow vertical web member, (b) horizontal long flanges extending perpendicularly an equal distance either side of the base of the web member, (c) horizontal short flanges extending perpendicularly an equal distance either side of the web member in the vicinity of the midpoint of the vertical web; and (d) a fabric material covering the sides and end of the narrow vertical web in the area from the short flanges to the end of the web opposite from the end of the web having the long flanges.

2. The spline structure of claim 1 wherein:

(a) the portion of the vertical web covered with fabric material being enlarged with a semicircular cross-section formed at the end of the vertical web.

3. A wallboard joint structure wherein:

(a) two wallboard structures with a front, back and at least one side are placed with their sides in an adjacent and slightly spaced apart relationship to form an open space joint between the wallboard sides with their backs against a structural wall, the wallboard front is covered with a fabric material, (b) a spline structure being positioned between the sides of the wallsboards to fill the space between the sides of the wallboards with only one end of the spline structure visible in the space between the wallboards; and (c) said spline structure having a semicircular cross-section formed on the visible end thereof and said semicircular cross-section being covered with a fabric material whereby, the spline structure filling the open space of the joint between two wallboards to provide the appearance of a semicircular bead between the adjacent wallboards.

4. The wallboard joint structure of claim 3 wherein the spline structure comprises:

(a) a narrow vertical web member, (b) horizontal long flanges extending perpendicularly an equal distance either side of the base of the web member with the flanges between the structural wall and back of the wallboards and means passing through the flanges fastening said flanges to the structural wall; and (c) a fabric material covering the sides and ends of the vertical web in the area from the mid-region of the web to the end of the web opposite from the end of the web having the long flanges, whereby the spline structure fills the open space of the joint between the two wallboards and does not extend over the front of the wallboards.

5. The wallboard joint structure of claim 4 wherein the spline structure comprises:

(a) horizontal short flanges extending perpendicularly an equal distance either side of the web member in the vicinity of the midpoint of the vertical web, and said wallboards on their adjacent sides having grooves in the mid region of the sides and said short flanges being inserted therein whereby the spline structure holds the wallboards in position relative to the structural wall.

* * * * *